United States Patent [19]

Campbell et al.

[11] Patent Number: 4,601,354

[45] **Date of Patent: * Jul. 22, 1986**

[54] MEANS AND METHOD FOR FACILITATING MEASUREMENTS WHILE CORING

[75] Inventors: Frank L. Campbell, Santa Ana; Dean C. Barnum, Fullerton; William C. Corea, Brea, all of Calif.

[73] Assignee: Chevron Research Company, San Francisco, Calif.

[ * ] Notice: The portion of the term of this patent subsequent to Jan. 8, 2002 has been disclaimed.

[21] Appl. No.: 646,863

[22] Filed: Aug. 31, 1984

[51] Int. Cl.[4] ..... E21B 47/09

[52] U.S. Cl. ..... 175/46; 175/58

[58] Field of Search ..... 175/46, 45, 40, 58, 175/244; 73/155, 151

[56] References Cited

U.S. PATENT DOCUMENTS

| | | | |
|---|---|---|---|
| 2,929,612 | 3/1960 | Le Bus, Sr. | 175/58 X |
| 3,982,433 | 9/1976 | Stout | 73/155 |
| 4,134,100 | 1/1979 | Funke | 175/40 X |
| 4,492,275 | 1/1985 | Campbell et al. | 175/58 X |
| 4,499,955 | 2/1985 | Campbell et al. | 175/58 X |
| 4,499,956 | 2/1985 | Campbell et al. | 175/58 X |

*Primary Examiner*—Stuart S. Levy

*Assistant Examiner*—Thomas R. Hannon

*Attorney, Agent, or Firm*—H. D. Messner; Edward J. Keeling

[57] ABSTRACT

In accordance with the present invention, rotation of the inner barrel relative of the axis of symmetry of the core barrel (indicative of core twist off or core sand erosion during coring operations) is detected by a novel sensor combination. The sensor includes a reed switch mechanically imbedded in a support sleeve of a custom safety sub attached to the outer core barrel and electrically actuated by an adjacently positioned signature magnet fitted to the inner barrel to connect a power source uphole from the core barrels with a driver valve of a mud pulser system.

During coring, circumferential passage of the reed switch adjacent to the signature magnet (during rotation of the outer core barrel to generate a core), allows the power source to periodically activate the valve driver to produce a series of mud pulses of constant repetition rate. But with the occurrence of rotation of the inner core barrel irregular repetition rates are produced at uphole indicating equipment. Result: sticking and jamming of the core can be immediately detected and uphole parameters modified to ease unsafe conditions.

8 Claims, 8 Drawing Figures

MEANS AND METHOD FOR FACILITATING MEASUREMENTS WHILE CORING

SCOPE OF THE INVENTION

This invention relates to the art of evaluating an earth formation penetrated by a well bore by means of cores taken from such formation and more particularly, to an improved method and apparatus for generating useful measurements while the core barrel is positioned in the well bore and operating to extract the core from the formation. Such information will hereinafter be referred to as "measurements while coring" or "MWC" data.

BACKGROUND OF THE INVENTION

The development of downhole instrumentation to evaluate drilling and coring of earth formations, has been given impetus by various governmental committees and councils. The Committee on Engineering Support for Deep Ocean Drilling for Science of the Marine Board of the National Research Council, e.g., joined with the Joint Oceanographic Institutions Board (scientific advisors to National Science Foundation's ocean drilling programs) to sponsor a "Symposium on Measurement While Drilling". The proceedings of the meeting are found in "Technologies for Measurement While Drilling" National Academy Press, Washington D.C., 1982. Prognosis: While instrumentation and uses involving measurements while drilling or (or "MWD"), are well-documented, gains to be obtained from measurements while coring (or "MWC"), have not yet crystallized.

Reasons: Many of most difficult well control problems occur when a core barrel is the well bore. Not only is the ability to handle well kicks reduced (because of reduced circulation capability) but there is increased likelihood of plugging and jamming. That is to say, the benefits to be gained from MWC during exploratory coring have not been documented in sufficient fashion to outweigh the safety concerns of the field operators. The above symposium had proposed use of a multisensor device to monitor coring operations, and the latter device included means for determining in real-time: weight-on-bit, torque-on-bit, resistivity, gamma response and core travel via acoustic response. Such a multisensor device is not only difficult to justify in view of the above, but it is also extremely expensive to manufacture.

RELATED APPLICATION

In our co-pending Application Ser. No. 522,922 for "Means and Method for Facilitating Measurements While Coring" filed Aug. 22, 1983, now U.S. Pat. No. 4,492,275, we specifically disclosed the fact that a Hall-effect device attached to the outer core barrel and carried in rotation therewith, could (in conjunction with a signature magnet fitted to the inner core barrel) provide a surprisingly accurate indication of relative rotation between the barrels during coring operations. Signal patterns (due to relative rotation of the barrels) as the Hall-effect device passes in close proximity of the magnet, could be easily detected at the earth's surface.

While experience has shown that Hall-effect devices have certain features useful in carrying out downhole operations, they have certain disadvantages in certain circumstances. For example, since the Hall-devices are themselves the source of control signals for the downhole mud pulser, they must be protected against the rather high downhole temperature and pressure conditions conventionally encountered adjacent the coring barrels.

SUMMARY OF THE INVENTION

In accordance with the present invention, a reed proximity switching device is used to disconnectably connect a power source positioned uphole from the coring barrels, with the driver valve of the mud pulser also uphole from the reed device. The switching device comprises a reed switch including two overlapping, flat, cantilevered ferromagnetic contacts encapsulated within a gas-filled glass cylinder having frits through which electrical conductors for the power source and mud pulser extend; and an actuating permanent magnet placed in close proximity of the reed switch. In more detail after the reed contacts and glass cylinder have been sandwiched between two slabs of plastic (much like lox in a bagel), the resulting combination is imbedded in a custom sub. The sub, in turn, is attached to the outer core barrel. A small air gap separates the free overlapping ends of the contacts but when magnetic induction occurs (as when the permanent magnet attached to the inner core barrel is placed adjacent to the contacts) causes the latter to attract each other and close. Such closure allows the power source to activate the valve driver of the mud pulser, and change the size of a drilling mud orifice so as to generate pulses in the drilling mud. The pulses are decoded at the earth's surface by conventional equipment.

During coring, circumferential passage of the reed switch device adjacent to the signature magnet (during rotation of—alone—the outer core barrel to generate a core), produces a series of signals of constant repetition rate. But with the additional occurrence of rotation of the inner core barrel (indicative of core twist-off, or core sand erosion) a change in repetition rate of the signal is produced at uphole indicating equipment. Result: sticking and jamming of the core can be immediately detected and uphole parameters modified to ease unsafe conditions. The safety sub of the present invention allows use of MWC equipment uphole, easily houses the reed switch adjacent to the signature magnet as well as facilitates communication of data uphole for operator evaluation and reactive response, if required.

Since the reed switches are surprisingly rugged in design and construction, are inexpensive as well as being unaffected by high or low temperatures and pressures, they unexpectedly aid in providing accurate indications of relative rotation of the core barrels during coring operations, (in conjunction with the current generator and mud pulser uphole from the switch).

DESCRIPTION OF THE PREFERRED EMBODIMENT

Figure 1:
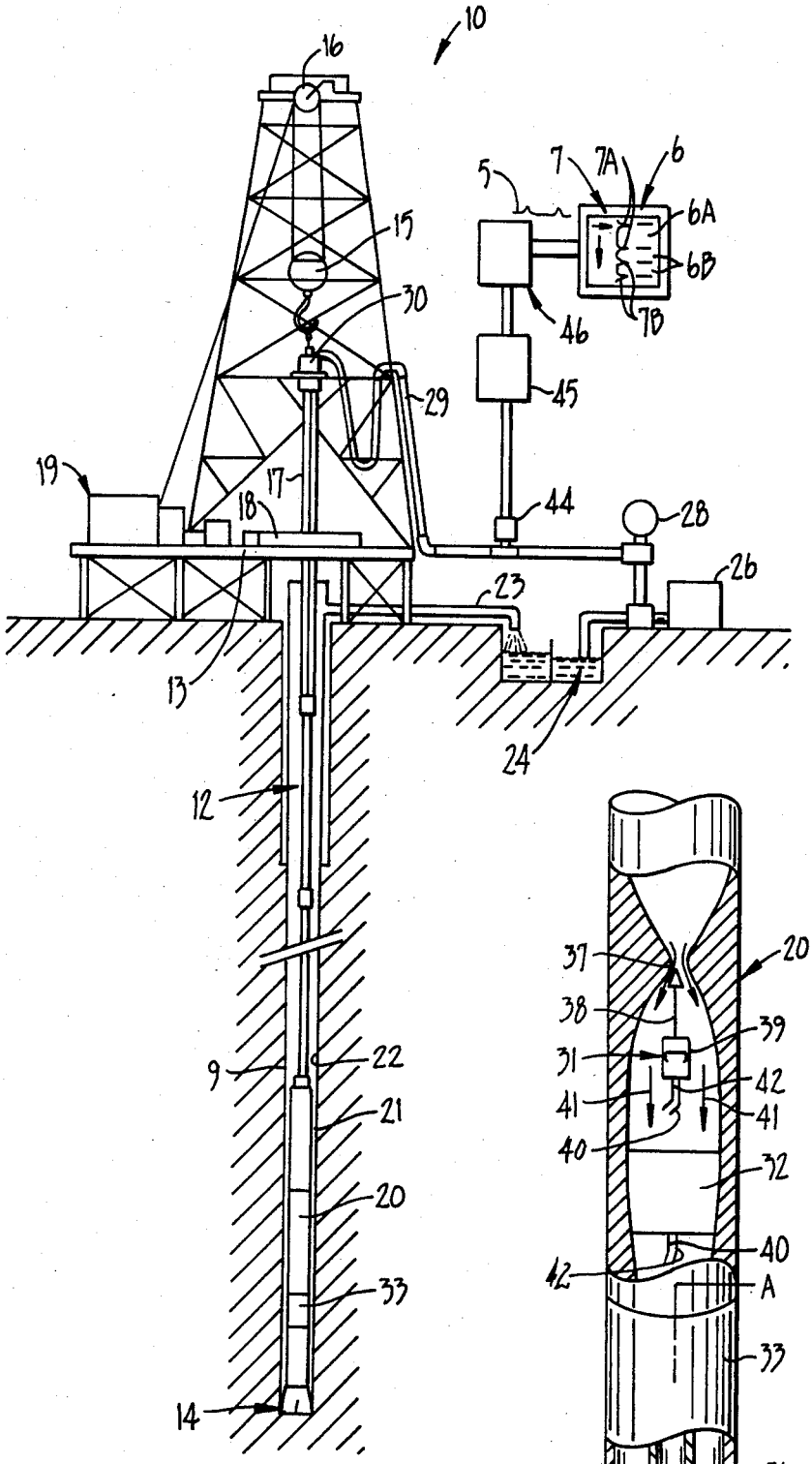
FIG. 1 is a schematic drawing of a well bore and drilling derrick showing the environment in accordance with the present invention.

Referring now to FIG. 1, the general environment is shown in which the present invention is employed. It will, however, be understood that the generalized showing of FIG. 1 is only for the purpose of showing a representative environment in which the present invention may be used, and there is no intention to limit applicability of the present invention to the specific configuration of FIG. 1.

The coring apparatus shown in FIG. 1 has a derrick 10 which supports a drill string or drill stem 12 which terminates in a core barrel 14. As is well known in the art, the entire string may rotate, or the drill string may be maintained stationary and only the outer core barrel rotated. The drill string 12 is made up of a series of interconnected segments, with new segments being added as the depth of the well increases. The drill string is suspended from a movable block 15 of a winch 16 and the entire drill string is driven in rotation by a square kelly 17 which slidably passes through but is rotatably driven by the rotary table 18 at the foot of the derrick. A motor assembly 19 is connected to both operate winch 16 and rotary table 18.

The lower part of the drill string may contain one or more segments 20 of larger diameter than other segments of the drill string. As is well known in the art, these larger segments may contain sensors and electronic circuitry for sensors, and power sources, such as mud driven turbines which drive generators, to supply the electrical energy for the sensing elements. A typical example of a system in which a mud turbine, generator and sensor elements are included in a lower segment 20 is shown in U.S. Pat. No. 3,693,428 to which reference is hereby made. These elements within segment 20 will hereafter be referenced as "measuring while coring" elements or "MWC" elements. During coring a large mud stream is in circulation. It rises up through the free annular space 21 between the drill string and the wall 22 of well bore 9. That mud is delivered via a pipe 23 to a filtering and decanting system, schematically shown as tank 24. The filtered mud is then sucked by a pump 26, provided with a pulsation absorber 28, and is delivered via line 29 under pressure to a revolving injector head 30 and thence to the interior of the drill string 12 to be delivered to the core barrel 14 as well as to MWC elements within segment 20.

The mud column in drill string 12 also serves as the transmission medium for carrying signals of one (or more) coring parameters to the surface. This signal transmission is accomplished by the well known technique of mud pulse generation whereby pressure pulses are generated in the mud column at segment 20 in a form capable of being detected at the earth's surface. The signals are representative of a selected coring parameter measured within the well bore 9 at custom sub 33 above the core barrel 14.

A particular coring parameter to be sensed by the present invention is rotation of cylindrical inner barrel 34 (see FIG. 2) even though outer barrel 36 also rotates. But other parameters could also be sensed, if desired, along lines previously mentioned.

Figure 2:
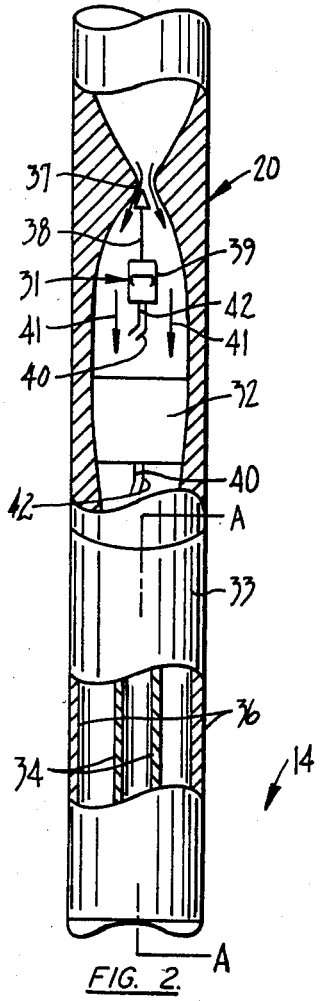
FIG. 2 is an enlarged section of the drill string of FIG. 1 illustrating still further the environment to which the present invention relates.

FIG. 2 also illustrates in schematic form, generation of mud pulses within drill string segment 20 indicative of the aforementioned parameter associated with operations of core barrel 14.

As shown, the drilling mud flows through a variable flow orifice 37 control by plunger 38. The plunger 38 has a valve driver 39 whose electrical conductors 40, 42 are connected via control elements within sub 33 to power generator 32. The time increments of activation cause variations in the size of orifice 37 through controlled movement of the plunger 38 via operation of valve driver 39. As seen in the FIG., mud flow is downward in the direction of arrow 41 and impacts upon mud turbine 31. As rotation of the turbine 31 occurs, the electrical generator 32 (previously mentioned) is caused to rotate and produce electrical energy. Such energy is transmitted to custom sub 33 via conductors 40, 42 and thence to valve driver 39 for detecting of rotation of the inner core barrel 34 about central axis A—A of symmetry as discussed in detail below.

Uphole, pressure pulses established in the mud stream as a function of the aforementioned selected coring parameter, are detected at signal transducer 44 (FIG. 1) which converts the mud pulses to electrical signals having an amplitude (or intensity) proportional to the pressure in the duct. A filter 45 removes parasitic signals due to the steady pressure pulsations of the pump 26 not removed by pulsation absorber 28. Decoding device 46 produces a record of response signal 5 whose amplitude v. time characteristic is representative of the coring parameter of interest, as set forth below.

It should be noted that instead of using the electrofluid transducing system of FIG. 2, modifications in this regard are possible. For example, electrical conductors 40, 42 could be connected—directly—to suitable transducing and decoding means located at the earth's surface. Such direct connection would, of course, be conditioned on the fact that adequate protection of the conductors 40, 42 within the drill string 12 is possible; i.e., conductor abuse during coring operations, would be minimal.

As previously indicated, while various classes of coring parameters at core barrel 14 could be sensed during operations, it has been found that in the occurrence of relative rotation of the inner core barrel 34, as the outer barrel 36 is also rotating, is surprisingly indicative of unsafe coring conditions at the bottom of the well bore 9. That is to say, when the inner barrel 34 starts to rotate about axis of symmetry A—A of sub 33 and core barrel 14, immediate uphole action is necessary. Such occurrence is indicated at decoding device 46 by a change in the repetition intervals 6 of signal 5 measured between pulses 7 associated with the coring operations. That is to say, rotation only of the outer core barrel 36 would provide pulses 7A of constant repetition spacing 6A, while rotation of the inner core barrel 34 as the outer core barrel 36 also rotates, produces a changed interval spacing 6B between the adjacent pulses 7B.

In order to ascertain that the change in interval spacing 6B is actually due to inner core barrel rotation (and not caused by just a change in coring speed), the motor assembly 19 (FIG. 1) is fitted with a tachometer means 13. By recording the rotation of tachometer means 13 as a function of time and cross-checking the result with the recorded signal 5 of decoding device 46, the actual occurrence of inner barrel rotation is more easily determinable.

Figure 3:
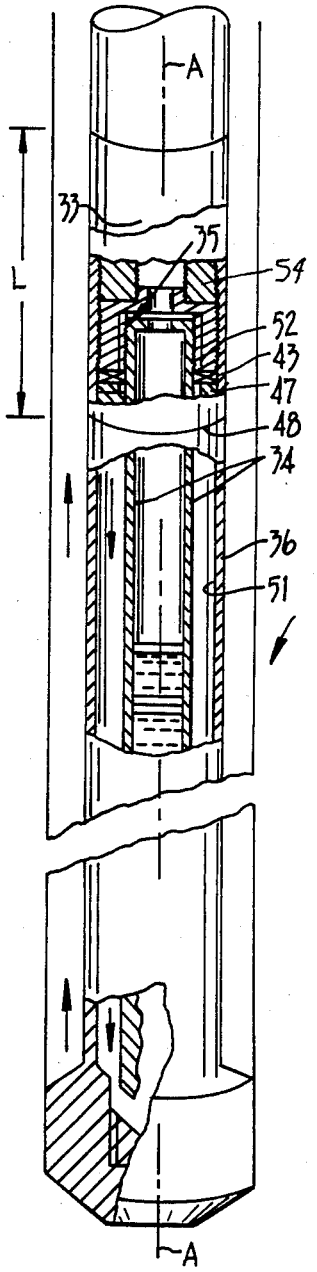
FIG. 3 is a view, partially in section, of a core barrel modified in accordance with the present invention.

FIG. 3 ilustrates the construction and operation of core barrel 14, in still more detail, with emphasis being placed on reasons for use of custom sub 33.

Assume that the custom sub 33 has an overall length L equal to that amount of a conventional outer core barrel 36 removed to accommodate sensor unit 35 of the present invention, in safety. I.e., in accordance with a particular design that is useful in the present invention, a conventional core barrel 14 has to be modified as follows. The uphole end of the outer barrel 36 must be cut away but the remaining terminus should be provided with a flanging surface 48. While the inner barrel 34 remains constructionally intact (except for modifications to mount an element of the sensor unit 35 as discussed below) a new core bearing and race support must be first provided. This is achieved via mounting the removed, previously used, core bearing 43 and its race between ledge 47 (on inner side surface 51 of outer barrel 36) and bottle-shaped retaining sleeve 52. A take-up ring 54 threadable attaches above sleeve 52 to provide needed axial leverage to affix the sleeve 52 and the core bearing 43 in its new operating environment. When the aforementioned modification has been achieved and inserted into a well bore, not only can cores be easily provided, that is, via rotation of the outer barrel 36 through the operations of the drill string as before, but also any rotation of the inner barrel 34 about axis of symmetry A—A can also be detected via sensor unit 35.

Detection occurs via sensor unit 35 wherein operations are in accordance with magnetic and electrical principles as discussed below. Since the sensor 35 contains no exposed moving parts, it offers high reliability notwithstanding exposure to mechanical shock and vibrations in a well bore environment.

FIGS. 4, 5, 6, 7 and 8 show the sensor unit 35 of the present invention in more detail.

Although theoretically many kinds of detection devices could be used, in accordance with the present invention, device 35 comprises only two elements: (i) a reed switch 55 sandwiched between two slabs of plastic 79 imbedded in inner surface 58 of the previously mentioned retaining sleeve 52 of custom sub 33 (FIG. 4); and (ii) a permanent magnet 59 (see FIG. 5) housed within recess 60 of support ring 57. A common flexible shield 63 protects conductors 40, 42 in their traverse of the distances separating the reed switch 55 from the power generator 32 and the mud pulsing system, viz., in the region between the generator 32, the sensor device 35 and the drive valve 39 of FIG. 2. Rugged constructional qualities of the device make it ideal for downhole operations. Discussions of reed switches can be found in "Radio Shack Dictionary of Electronics", R. F. Graf, Editor, 4th Edition at page 483 as well as in "Allied Electronics 1983–1984 Engineering Manual and Purchasing Guide" at page 216, published by Allied Electronics, Elgin, Ill., which reference is made for incorporation herein as to construction, availability and theory of operation.

Figure 6:
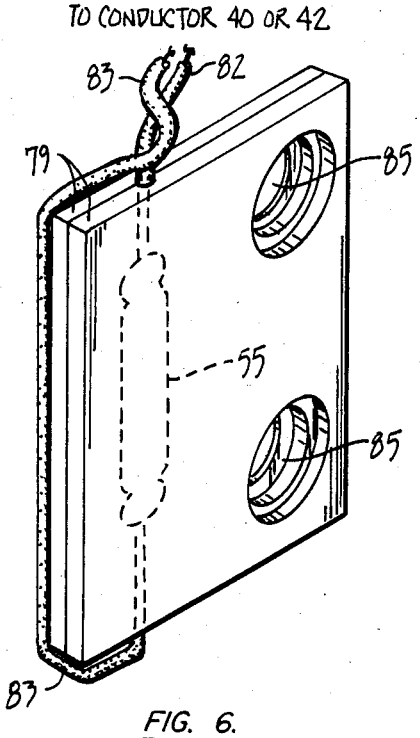
Figure 7:
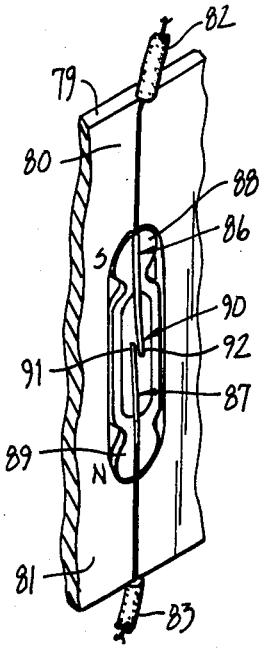

FIGS. 6 and 7 illustrate the construction of the reed switch 55 in more detail.

In FIG. 6, the switch 55 is shown in phantom line sandwiched between slabs of plastic 79 and includes leads 82, 83 that connect in series with and forms the integral switching leg of one of the two uphole conductors 40 or 42 that interconnect the generator 32 with the valve driver 39. Openings 85 extend through the slabs 79 to allow for their attachment to the retaining sleeve 52, as by fasteners (not shown), if required.

In FIG. 7, one of the plastic slabs 79 has been removed to illustrate the switch 55 in still more detail.

As shown, the switch 55 includes a pair of flat, cantilevered ferromagnetic reed contacts 86, 87 encapsulated within gas-filled glass cylinder 88. The ends of the contacts 86, 87 make electrical connection with leads 82, 83 via connectors 80, 81 after immerging from the ends of cylinder 88. A small air gap (generally indicated at 90) separates the free overlapping ends 91, 92 of the contacts 86, 87 when the switch is in an inactive state.

When the reed switch 55 is to be activated by bringing permanent magnet 59 in close proximity (and place generator 32 in direct driving electrical contact with driver 39 via conductors 40, 42 since leads 82, 83 are interconnected in series with one of the conductors 40 or 42 as previously mentioned), the free overlapping ends 91, 92 attract each other. Electrical contact is thereby established between the power generator 32 and the mud pulsing system.

Figure 8:
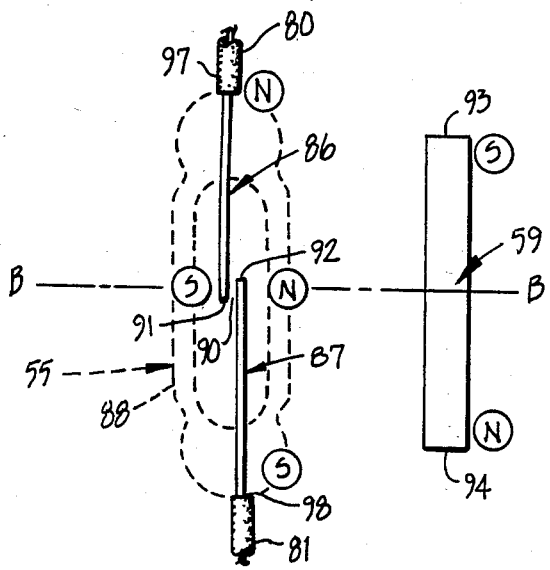

FIG. 8 illustrates how reed contacts 86, 87 within glass cylinder 88, are magnetized.

As shown, when permanent magnet 59 having ends 93 and 94, respectively, is placed adjacent to the switch 55, flux lines produce a magnetic induction in both flat reed contacts 86, 87. Since initially each contact 86, 87 is separated by air gap 90, and the overlapping ends 91, 92 intersect the mid-point of the permanent magnet 59 along axis B—B, the pole designations of each contact 86, 87 are in direct opposition to each other as in manner set forth in the FIG. 8. In more detail, if end 93 of the magnet 59 is the south pole and end 94 is the north pole, then reed contact 86 has a south pole as its cantilevered free end 91 and a north pole at its attaching conductor connecting end 97; similarly, for reed contact 87, it has inducted a north pole at its cantilevered free end 92 and a south pole at its attaching end 98. Obviously, as the magnetic flux density increases, (as where the distance between the permanent magnet 59 and the reed contacts 86, 87 is decreased), the magnetic induction with each contact increases, and the overlapping ends 93, 94 being opposites attract, and make contact.

Figure 4:
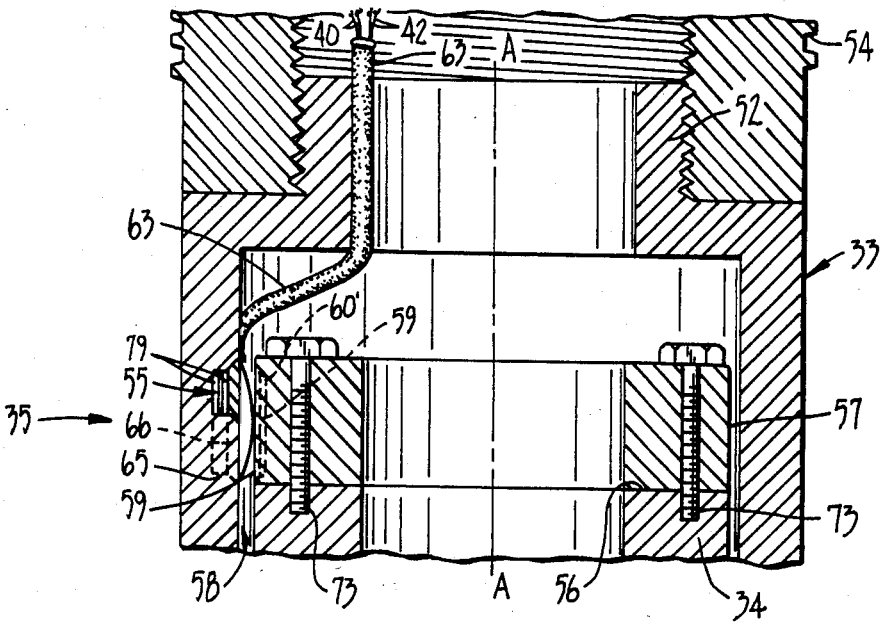
FIGS. 4–8 are further details of FIG. 3.
Figure 5:
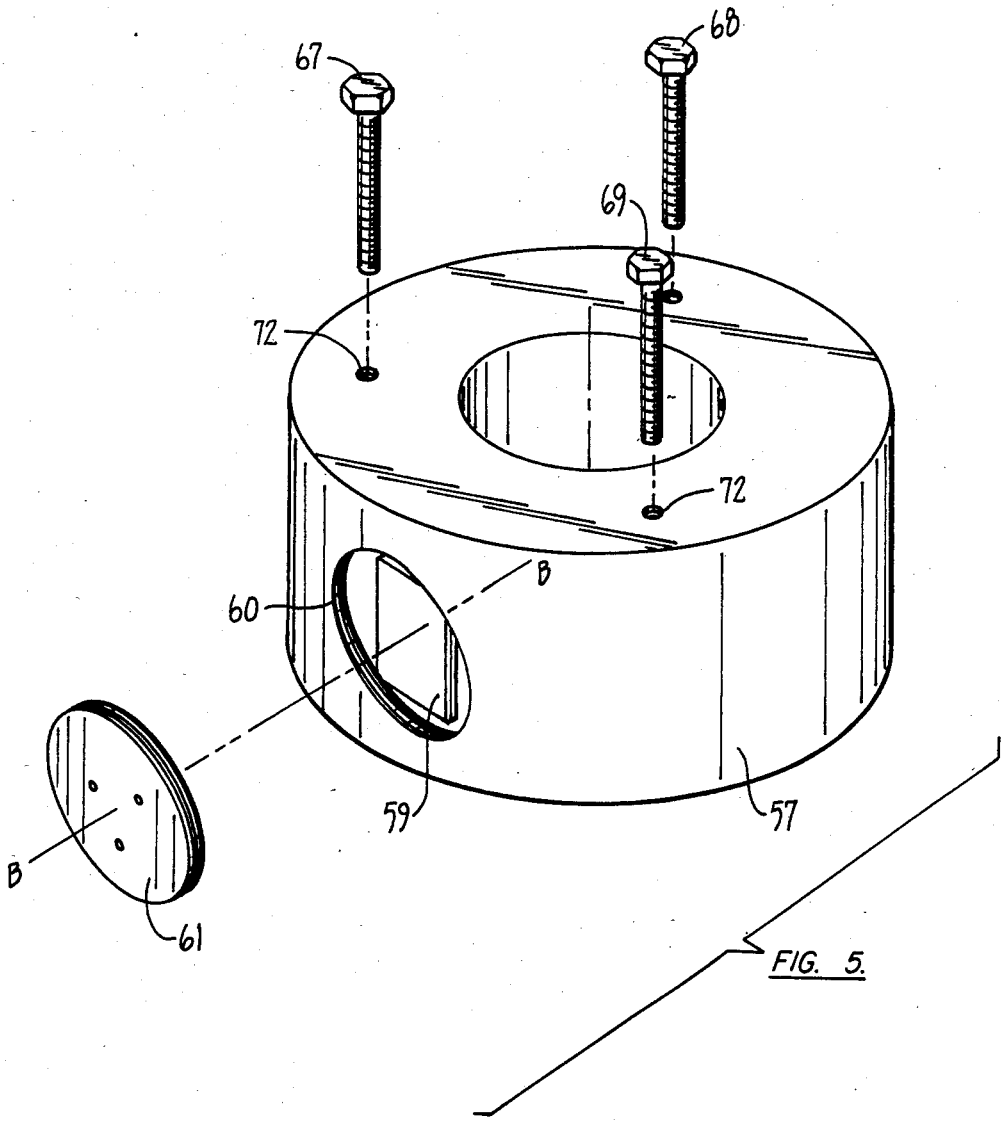

Rotational movement of the outer barrel 36 about central axis A—A is, of course, contemplated in FIG. 4.

During such operations, the reed switch 55 and signature magnet 59 are placed adjacent to each other only once each revolution of the outer core barrel. In that way the series of electrical signals, previously discussed, are generated on a repetitive basis. That is, each time the switch 55 passes in close proximity of the signature magnet 59, a signal is generated. Note that the area of proximity varies with the sensitivity of the switch 55, but in general is measured over an imaginary sector defined by a cutting plane that intersects the axis of rotation of the core barrel at about 90 degrees. The sector has a mean radial directional vector momentarily along axis B—B (FIG. 5) that intersects the side wall of the well bore; during each revolution of the outer core barrel, that sector momentarily captures both the switch 55 and the signature magnet 59. Since the conductors 40, 42 and shield 63 also rotate about that axis in synchronization with uphole connection points to driver 39 (FIG. 2) and generator 32, respectively, tangling of cabling during coring operations, is prevented.

To reduce the possibility of drilling mud intrusion yet allow easy removal for repair purposes, the switch 55 as well as signature magnet 59 are both provided with suitable mounting arrangements within the retaining sleeve 52 and support ring 57, respectively. In the case of switch 55, after it has been secured within plastic slabs 79 (FIG. 6), extend the combination is fitted within a recess 65 formed at the inner surface 58 of the sleeve 52. Recess 65 is capped by a threaded insert 66 through which leads 82, 83 (FIG. 6) for connection to conductor 40 or 42 within shield 63. For magnet 59, its recess 60 (at the circumferential edge of support ring 57, see FIG. 5) is sealed by threadable insert 61 defining an axis B—B normal to, but intersecting the central axis A—A of the assembly.

The magnetic axis of magnet 59 is parallel to axis A—A, however. Of course, the support ring 57 must be affixed to the inner barrel 34 and this is achieved via threaded bolts 67, 68 and 69 equally spaced about central axis A—A that screw into the terminus 56 of the inner barrel 34, see FIG. 4. The bolts 67, 68, 69 extend through oversized holes 72 in support ring 57. The length of the bolts and the depth of threads 73 in the inner barrel 34.

From the foregoing description, one skilled in the art can easily ascertain the essential characteristics of the present invention and without departing from the spirit and scope thereof, can make various changes and modifications of the invention to adapt it to various usages and conditions.

For example, some attention as to the materials to be used in the construction of the custom sub 33 as well as for support sleeve 57 are needed. Since both assemblies are to be magnetically non-interactive, they should be of stainless steel or monel.

Consequently, such changes and modifications are proper, equitable and intended to be within the full range of equivalence of the following claims.

What is claimed is:

1. Apparatus for monitoring detrimental conditions associated with extraction of a core from an earth formation penetrated by a well bore using a core barrel having a rotatable outer cylindrical barrel attached to and operationally rotated by, a drill string, and drilling fluid circulating within said well bore as said core is extracted, wherein rotation of a usually stationary inner core barrel coaxial of the outer core barrel during said extraction of said core and its placement thereof within the cylindrical inner barrel, is used to indicate said associated detrimental coring conditions, comprising;

first means mechanically attached to said core barrel and operationally fitted between said outer and inner core barrels for generating a series of signals indicative of relative rotation of the inner core barrel relative to the outer core barrel during extraction of said core from the formation;

second means uphole from said first means and operational connected thereto for responding to said series of signals indicative of said relative inner barrel rotation wherein occurrence of said relative inner barrel rotation, causes operations to be initiated to overcome any associated detrimental condition within said well bore.

2. Apparatus of claim 1 in which said first means for generating said series of signals indicative of said relative rotation of said inner core barrel during extraction of said core from said formation, includes a reed switch operationally attached to the outer core barrel and carried in rotation therewith, a single signature magnet fitted to said inner core barrel, a power source and a mud pulsing system, said power source being disconnectably connected to said mud pulsing system each time said reed switch passes in close proximity of said single signature magnet, during rotation of at least one of said barrels, said regions of close proximity being defined by a cutting plane that intersects the axis of rotation of the core barrel at about 90 degrees, said imaginary sector momentarily capturing said reed switch and said single magnet during rotation thereof.

3. Apparatus of claim 2 in which said mud pulsing system of said first means generates mud pulses in response to a series of electrical signals intermediately occurring between said power source and said mud pulsing system, as said reed switch is intermediately closed when in the close proximity of said signature magnet during rotation of at least said outer barrel.

4. Apparatus of claim 3 in which said second means also includes transducer means at the earth's surface for converting the pressure impulses imparted to the drilling fluid to surface electrical signals having amplitude variations proportional to the pressure impulses, and recording means connected to said transducer means for recording said surface electrical signals as a function of time.

5. Apparatus of claim 4 in which indication of inner barrel rotation is determined by establishing a signal repetition rate of said surface signals wherein rotation of said inner barrel is known not to occur, and comparing that rate with a subsequently generated changed rate resulting from inner barrel rotation.

6. Apparatus of claim 5 in which said power source includes an electrical generator mechanically connected to a mud turbine over which said drilling mud passes whereby said generator is driven in rotation, said generator having conductors connected to said mud pulsing system wherein one conductor thereof connects through said reed switch whereby said series of electrical signals are generated as said switch repetitively passes in close proximity of said single signature magnet.

7. Apparatus of claim 1 in which said generated signals are mud pulses in the form of pressure impulses imparted to the drilling mud, and said second means includes recording means positioned at the earth's surface operationally connected to said first means for recording said mud pulses as a function of time.

8. Apparatus of claim 7 in which said second means provides indication of said relative inner barrel rotation by establishing a repetition rate of said mud pulses as a function of time when said inner barrel is known not to rotate and comparing that rate with a subsequently generated changed rate resulting from relative inner barrel rotation.

* * * * *